United States Patent [19]

Reeve et al.

[11] Patent Number: 5,057,150

[45] Date of Patent: Oct. 15, 1991

[54] PRODUCTION OF ALUMINUM MASTER ALLOY ROD

[75] Inventors: Martin R. Reeve; Pervez J. Bamji; Barrie Chamberlain; John Sulzer, all of Kingston, Canada

[73] Assignee: Alcan International Limited, Montreal, Canada

[21] Appl. No.: 515,168

[22] Filed: Apr. 26, 1990

[30] Foreign Application Priority Data

May 3, 1989 [CA] Canada ..... 598583

[51] Int. Cl.[5] ..... C22B 21/06

[52] U.S. Cl. ..... 75/671; 75/678; 75/684; 75/685; 420/552

[58] Field of Search ..... 75/671, 678, 684, 685; 266/212, 215, 216, 234; 420/552

[56] References Cited

U.S. PATENT DOCUMENTS

| | | | |
|---|---|---|---|
| 3,272,617 | 9/1966 | Fennell | 75/379 |
| 3,767,382 | 10/1973 | Bruno et al. | 75/678 |
| 3,785,807 | 1/1974 | Backerud | 420/552 |
| 3,857,705 | 12/1974 | Miyasaka et al. | 75/684 |
| 3,961,995 | 6/1976 | Alliot et al. | 420/552 |
| 4,298,377 | 11/1981 | Szekely | 75/560 |
| 4,484,731 | 11/1984 | Taniguchi | 266/216 |

*Primary Examiner*—R. Dean
*Assistant Examiner*—Robert R. Koehler
*Attorney, Agent, or Firm*—Cooper & Dunham

[57] ABSTRACT

A continuous process is described for the production of an aluminum master alloy, e.g. an Al-Ti-B grain refining rod, in which molten aluminum is continuously passed through a confined reaction zone. Particulate titanium and/or boron precursor compounds, e.g. salts, are continuously added to the molten aluminum in the reaction zone and the content of the reaction zone is continuously stirred to submerge the salts within the aluminum melt and form an alloy therewith. A mixture of formed molten alloy and entrained reaction products is continuously transferred from a lower region of the reaction zone into a refining zone, with reaction product slag being collected on the surface of the molten alloy in the refining zone. The molten alloy formed is continuously transferred via a transfer conduit from the refining zone to a casting station.

12 Claims, 1 Drawing Sheet

PRODUCTION OF ALUMINUM MASTER ALLOY ROD

BACKGROUND OF THE INVENTION

This invention relates to a continuous process for the production of an aluminum master alloy and, more specifically, to an Al-Ti-B grain refining rod.

Typically, aluminum master alloys of the type contemplated by the present invention consists essentially of 2–12 wt % titanium, either alone or together with 0.1–2 wt % boron, and the balance being commercial grade aluminum with the normal impurities. Such Al-Ti-B master alloys are conventionally produced batchwise in an electric induction furnace. The alloying ingredients are typically provided in the form of the double fluorides of titanium and boron with potassium, e.g. potassium fluorotitanate ($K_2TiF_6$) and potassium fluoroborate ($KBF_4$). The batching process typically comprises the following stages:

1. Alloying

A mixture of fluoride salts in the required proportion is fed to a stirred body of molten aluminum in an induction furnace at a temperature within the range of about 700°–800° C. By means of an electromagnetic stirring action, the salt mixture is drawn below the surface of the melt where reduction to Ti and B by the Al takes place.

2. De-Slagging

The above alloying reaction results in a product which comprises molten potassium aluminum fluoride. Periodically during the alloying process, and the end of the process, electric power is shut off to allow the molten reaction products to rise to the surface of the molten metal where they form a discrete slag layer. This slag is removed by decanting into a suitable receptacle, such as a slag pan.

3. Casting

The batch of molten alloy may optionally be transferred into a separate casting furnace. This is also typically an electric induction furnace in which electromagnetic stirring helps to keep the insoluble $TiB_2$ particles suspended within the molten alloy body. The alloy may be cast into either an ingot for further working to rod by rolling or by extruding or directly into a rod casting machine, such as a Properzi caster.

The above known process has a number of significant disadvantages. Firstly, the product quality, particularly microstructure and grain refining properties, varies from batch to batch. Secondly, the alloying process produces environmentally damaging fluoride-containing fumes in the form of intense emissions for a short period of time and this necessitates an expensive emission control system large enough to handle the periodic high emission rates. Thirdly, the system is capital intensive.

It is also known to use continuous alloying processes utilizing a flowing stream of molten metal. For instance, U.S. Pat. No. 4,298,377 discloses a method and apparatus for adding solids to molten metal by continuously feeding both the solids and the metal into a vortex-forming chamber from which the mixture is discharged at the core of the vortex as a free-falling, hollow-centered stream.

U.S. Pat. No. 3,272,617 discloses a method and apparatus for continuously pouring a stream of molten metal to form a vortex into which a particulate alloying or heating agent is introduced and where the intensity of the vortex is controlled to immerse the additives in the molten metal at any desired rate.

Another method and apparatus are disclosed in U.S. Pat. No. 4,484,731 for continuously treating molten metal with a treatment agent which is continuously introduced into a treating vessel through a supply passage formed through the wall of the vessel. The molten metal is continuously poured into the lip of the vessel and discharged from the lower part of the vessel after addition of the treating agent.

It is an object of the present invention to provide an improved form of continuous alloying process which is especially well adapted for the production of an aluminum master alloy, such as an Al-Ti-B grain refining rod.

SUMMARY OF THE INVENTION

The present invention relates to a process for producing an aluminum master alloy in which molten aluminum is continuously passed through a confined reaction zone. Particulate titanium and/or boron precursor compounds, e.g. salts, are continuously added to the molten aluminum in the reaction zone and the content of the reaction zone is continuously stirred to submerge the salts within the aluminum melt and form an alloy therewith. A mixture of formed molten alloy and entrained reaction products is continuously transferred from a lower region of the reaction zone into a refining zone, with reaction product slag being collected on the surface of the molten alloy in the refining zone. The molten alloy formed is continously transferred via a transfer conduit from the refining zone to a casting station.

The titanium and/or boron precursor that is added is a material which is reducible by molten aluminum to free the metal itself. This is typically in the form of a salt, for example, a double fluoride of titanium or boron with an alkali metal, such as potassium. A mixture of potassium fluorotitanate ($K_2TiF_6$) and potassium fluoroborate ($KBF_4$) is particularly preferred. The titanium is typically added in an amount of 2–12 wt % and the boron is typically added in an amount of 0.1–5 wt %, while the mixed salt is typically added in an amount of 2–12 wt % titanium and 0.1–2 wt % boron.

The confined reaction zone may either be a separate vessel or a compartment in a common vessel. The stirring within the reaction zone is preferably conducted such that a vortex is formed and this vortex may be created in a number of different ways. For instance, it may be electromagnetically generated or a power-driven rotating impeller may be used to form the vortex. The reaction zone is typically at a temperature in the range of 700° to 850° C.

The refiner may also be either a separate vessel or a compartment in a common vessel and comprises a zone in which reaction product slag, because of its lower density, moves to the surface of the molten metal. The refiner is preferably a relatively deep vessel with a quiescent zone at the top and a turbulent zone at the bottom. The bottom turbulence may conveniently be created by means of an electromagnetic vortex generator. The reaction products may be removed either continuously or periodically by way of a suitably positioned spout at the top of the refiner at the level of the slag layer.

It may also be desirable to sparge inert gas upwardly through the refining zone to remove globules of molten salts. In some instances, it is also desirable to utilize a secondary refining stage to remove fine entrained globules of slag. This may be done by inserting one or more slag-wettable tiles suitably positioned in a turbulent stream of metal to entrap the impinging slag globules. These tiles may comprise a honeycomb or they can be serrated to increase their contact surface. The wettability to salts may be enhanced by suitably coating the tiles with, for instance, $CaF_2$ or $MgF_2$, etc.

The transfer conduit is preferably in the form of a transfer trough and this serves to lead the molten alloy from the refiner to the casting station. To keep the borides in suspension up to the final moment when the metal enters the caster, it is advantageous to incorporate with the trough a linear induction motor preferably having windings which are preferentially energized with more power at the upstream end of the trough than at the downstream end. This leads to necessary sub-surface movement of the metal along the trough.

If difficulties are encountered with electromagnetic transport of metal due to its viscosity, an inert sparging gas may be introduced into the alloy in the form of small bubbles. This has the effect of decreasing the viscosity.

The casting station may comprise any known system, including a continuous rod casting machine, a DC casting machine for casting extrusion ingots or wire bars or an ingot casting machine for casting master alloy ingot or waffle, for use in batch treatment of aluminum. It is particularly preferred to use the system of the present machine, such a Properzi caster.

BRIEF DESCRIPTION OF THE DRAWINGS

Certain preferred embodiments of the present invention illustrated by the appended drawings in which.

DESCRIPTION OF THE PREFERRED EMBODIMENT

Figure 1A:
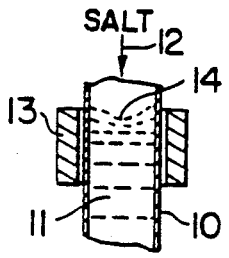
FIGS. 1*a* to 1*d* show four different techniques for stirring the material in the reactor.
Figure 1B:
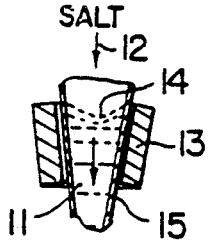
Figure 1C:
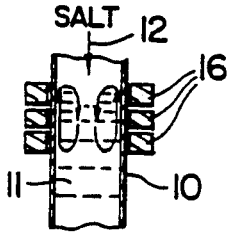
Figure 1D:
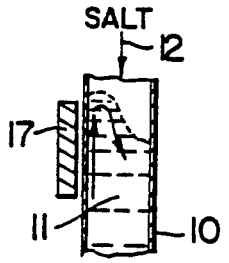

Looking specifically at FIG. 1, each of views 1(*a*) to (*d*) shows a reactor vessel 10 containing molten metal 11 and salt 12 being introduced. Looking particularly at FIG. 1(a), there is shown a conventional induction motor 13 which creates an essentially circular flow, thereby forming a vortex 14 through which the salt 12 is drawn into the melt.

FIG. 1(*b*) is similar to FIG. 1(*a*) but uses a conical reactor vessel 15 with a corresponding induction motor 13 to create a circular and downward flow.

In FIG. 1(*c*) there is shown 3-phase coils 16 and these cause a vertically downward flow as indicated in the drawing.

The use of a linear induction motor for stirring is shown in FIG. 1(*d*) with the linear induction motor 17 being placed vertically at the side of the reactor vessel 10. This creates a vertically upward flow along the wall of the reactor as shown.

Of course, a simple impeller or a tangential entry for the molten metal (not shown) may also be used to create an essentially circular flow.

Figure 2:
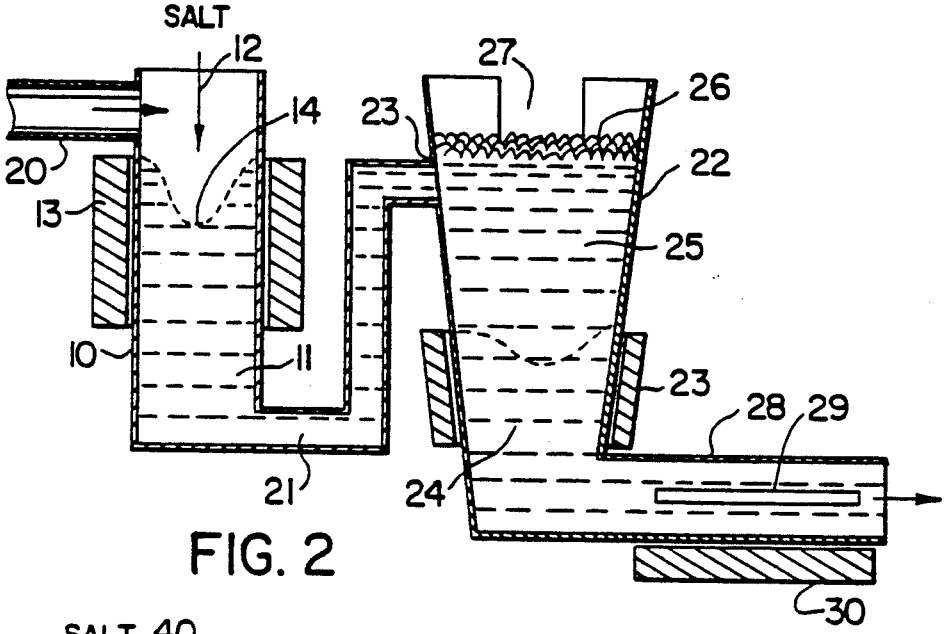
FIG. 2 is a schematic representation of a process utilizing separate reactor and refiner vessels.

A preferred system with separate reactor and refiner vessels is shown in FIG. 2. Here, the reactor vessel 10 includes a metal inlet 20 at the top, an outlet 21 at the bottom and an electromagnetic stirring mechanism 13. The vessel holds molten metal 11 which is stirred by means of the stirrer 13 to form a vortex 14 through which the salts 12 are drawn into the melt 11.

The reaction product is drawn off through bottom discharge 21 and is fed into refining vessel 22 at an upper inlet 23. The refining vessel is relatively tall and an electromagnetic stirrer 23 is provided in a lower region to create a lower turbulent zone 24 and an upper quiescent zone 25. Reaction product slag 26 forms on the top surface of the quiescent zone 25 and is drawn off through discharge 27.

The molten alloy is drawn off at the bottom through transfer trough 28 to a casting stage. A slag-wettable tile 29 is preferably positioned within the transfer trough and a linear induction motor 30 is preferably also provided which is preferentially energized such as to provide more power at the upstream end of the trough than at the downstream end. This provides the necessary subsurface movement of the metal along the trough such as to keep the borides in suspension.

Figure 3:
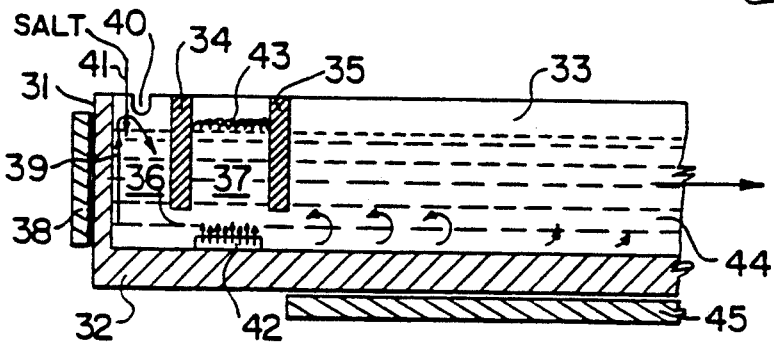
FIG. 3 is a graphic representation of the system in which the reactor and refiner are separate compartments.

An alternate form of system is shown in FIG. 3 in which the reactor and refiner are simply compartments in a total system. Thus, the system includes an end wall 31, a bottom wall 32 and side walls 33. Extending down from the top are divider walls 34 and 35 forming a reaction zone 36 and a refining zone 37 respectively. A linear induction motor 38 is positioned adjacent end wall 31 and this is designed to provide an upward flow of molten metal 39 adjacent the wall as shown to provide the necessary stirring.

The molten metal is introduced through inlet 40 and the salt is introduced through inlet 41 with mixing taking place within reaction zone 36. The reaction product exits through the gap below divider wall 34 and moves upwardly into the refining zone 37. A gas sparger 42 may be provided at this location if required. Reacted slag 43 is drawn off at the top and the molten alloy passes through the gap below divider wall 35 into the transfer trough 44. A linear induction motor with grated windings 45 is provided below the wall 32 in the transfer trough region.

We claim:

1. A process for producing an aluminum master alloy which comprises continuously passing molten aluminum through a confined reaction zone, continuously adding to the molten aluminum in the reaction zone at least one compound selected from titanium and boron compounds reducible by molten aluminum, continuously stirring the content of the reaction zone to submerge the titanium or boron compounds within the aluminum melt and form an alloy therewith, continuously transferring molten alloy and entrained reaction products from a lower region of the reaction zone into a refining zone, collecting reaction product slag on the surface of the molten alloy in the refining zone and continuously transferring molten alloy via a transfer means from the refining zone to a casting station.

2. A process according to claim 1 wherein the titanium and boron compounds are titanium and boron salts.

3. A process according to claim 2 wherein the salts are double fluoride salts of titanium and boron with an alkali metal.

4. A process according to claim 2 wherein a mixture of titanium and boron salts is used.

5. A process according to claim 1 wherein the reaction zone is stirred to generate a vortex.

6. A process according to claim 1 wherein the refining zone is a deep zone having a quiescent top zone and a turbulent bottom zone.

7. A process according to claim 6 wherein the refining zone is sparged with an inert gas to remove globules of molten salts.

8. A process according to claim 1 wherein the transfer means comprises a transfer trough.

9. A process according to claim 8 wherein the molten alloy flowing through the trough is stirred by means of a linear induction motor to keep borides in suspension.

10. A process according to claim 3 wherein 2–12 wt % titanium is added to the aluminum.

11. A process according to claim 3 wherein 0.1–5 wt % boron is added to the aluminum.

12. A process according to claim 4 wherein 2–12 wt % titanium and 0.1–2 wt % boron is added to the aluminum.

* * * * *